US007098887B2

(12) United States Patent
Rezania

(10) Patent No.: US 7,098,887 B2
(45) Date of Patent: Aug. 29, 2006

(54) DISPLAY DEVICE

(76) Inventor: Omid Rezania, 67 Commonwealth Rd., first Floor, MA (US) 02472

( * ) Notice: Subject to any disclaimer, the term of this patent is extended or adjusted under 35 U.S.C. 154(b) by 192 days.

(21) Appl. No.: 10/336,893

(22) Filed: Jan. 6, 2003

(65) Prior Publication Data

US 2003/0137500 A1 Jul. 24, 2003

Related U.S. Application Data

(60) Provisional application No. 60/349,497, filed on Jan. 18, 2002.

(51) Int. Cl.
*G09G 3/36* (2006.01)

(52) U.S. Cl. ..... 345/101; 345/204

(58) Field of Classification Search ..... 345/204, 345/205, 206, 101; 362/101
See application file for complete search history.

(56) References Cited

U.S. PATENT DOCUMENTS

| | | | | |
|---|---|---|---|---|
| 5,339,548 | A * | 8/1994 | Russell | 40/324 |
| 6,274,978 | B1 * | 8/2001 | Roach et al. | 313/483 |
| 6,621,766 | B1 * | 9/2003 | Brewer et al. | 368/82 |
| 6,728,166 | B1 * | 4/2004 | Grupp | 368/69 |
| 6,819,304 | B1 * | 11/2004 | Branson | 345/1.3 |

* cited by examiner

*Primary Examiner*—Richard Hjerpe
*Assistant Examiner*—Jean Lesperance

(57) ABSTRACT

A device is described which comprise of a thermoelectric unit and an electronic flexible display unit. An application of the device may be the device being mounted on a commercial hot beverage holder, whereby using the thermal energy from the hot beverage to display visual effects on the display unit.

6 Claims, 2 Drawing Sheets

DISPLAY DEVICE

RELATED APPLICATION

This application claims priority to U.S. Provisional Patent application No. 60/349,497 filed Jan. 18, 2002 the contents of which are incorporated herein by reference to its entirety.

BACKGROUND

Recently there has been significant improvements in the thermoelectric technology, with new devices becoming commercially available which are smaller, thinner, are more efficient and possess higher figures of merit as previously available.

At the same time, the advancement in display technology has made it commercially possible to obtain display units which are flexible and may conform to specific contours. The drivers and electronic components required for functioning of such displays have been available for years.

It is the object of the present patent application to disclose various novel and useful devices, based on the combination of flexible display technologies and thermoelectric technology.

BRIEF SUMMARY OF THE INVENTION

The invention comprises of a combination of components which may be attached to a source of heat or positioned in the vicinity of a heat source. The result is a device which uses the heat as the primary source of energy and displays a particular pattern(s) on the display unit. The invention utilized advancements in two categories, flexible display technology and thermoelectric technology.

Flexible displays include electronically addressable display, organic light emitting diodes (OLED) or similar displays. The driver comprises of EPROM microprocessor (or other commercially available non volatile memory unit, or other microchips with similar functionality) and the driver for the display.

Thermoelectric technology uses the temperature difference between two connecting bodies to generate electricity. The amount of electricity produced depends among other things on the amount of temperature difference and the type of materials used. Industry uses a number called figure of merit to measure the performance of thermoelectric devices, with higher numbers indicating higher performance. Recent thermoelectric components posses efficiencies high enough such that they are capable of providing the electrical energy sufficient to power the micro controller unit and the display unit.

The thermoelectric unit may be positioned adjacent to or attached to the heat source. The heat source provides the energy which is turned into electrical energy in the thermoelectric unit. The electrical energy provides the power for the display unit and the micro controller unit. The micro controller unit, which acts as the driver for the display unit, then sends the signals to the display unit, and the said display unit displays a particular visual effect. This visual effect may be text, graphics or a combination thereof.

BRIEF DESCRIPTION OF THE DRAWINGS

The drawings are not to scale, emphasis instead is placed on illustrating the principles of the invention.

DETAILED DESCRIPTION OF AN EMBODIEMENT

Figure 1:
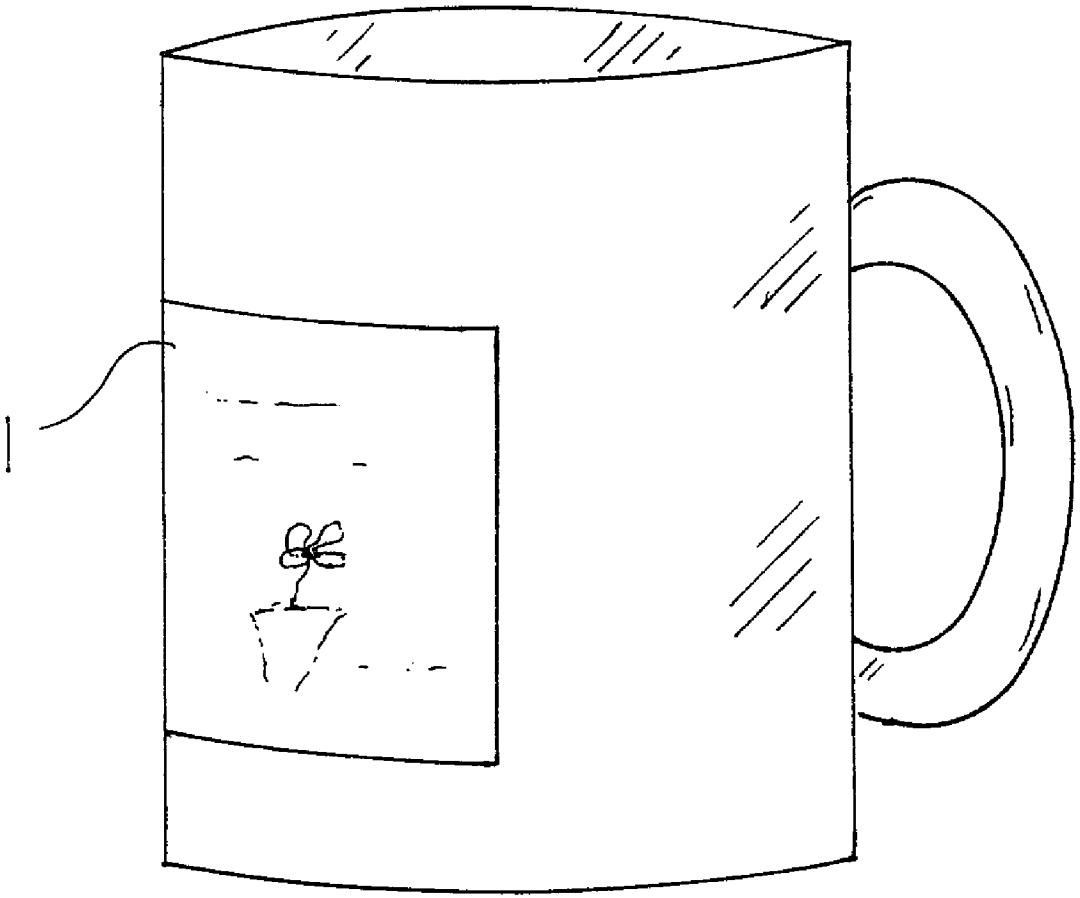
FIG. 1 is a schematic drawing of the particular embodiment of the invention described in the "Detailed Description of an Embodiment".

This section illustrates in detail a specific embodiment of the invention, namely the invention attached to the outside surface of a beverage holder.

In this embodiment of the invention, the display unit displays a different predetermined visual effect—or succession of said visual effects—each time a hot liquid is poured into a beverage holder. The displayed pattern comprise of text, graphics or any combination thereof. This embodiment comprise of three units, and means of packaging and connecting the said three units, as described below.

Thermoelectric Unit

The thermal energy is converted into electrical energy by means of one or more thermocouple elements. In this embodiment, the thermoelectric unit would be mounted on the outer surface of the liquid container, so as to absorb the heat which is conducted through the body of the liquid container towards outside.

Examples of commercially available thermoelectric components available for this embodiment are the ones produced by Applied Digital Solutions (www.adsx.com).

Recently thermoelectric units have been made with very high figures of merit, such as the new miniaturized electric generators developed by the firm Applied Digital Solutions (NASDAQ: ADSX), and noted in their press release of Oct. 1st, 2001. Other examples include devices developed by RTI International (www.rti.org) and reported in the 11 Oct. 2001 issue of the magazine Nature.

Micro Controller Unit

The controller unit comprises of a nonvolatile programmable memory chip and the display driver. Both the said memory chip and the display driver are available commercially as off the shelf products. The chip may also be designed and manufactured specifically for this invention as an application specific integrated circuit (ASIC) or other means with similar function.

The predetermined patterns to be displayed on the display unit are stored initially in the memory chip of the micro controller. The patterns may be stored in digital form and determine which set of pixels are to be turned on (activated) and which ones to be turned off (deactivated). The collection of the activated pixels on the display unit determine the final visual effects to be displayed. The said chip sends the data to the display driver. Display drivers are commercially available components and control the pixels on the display unit, whereby controlling the content to be displayed.

In this embodiment, a commercially available simple matrix driver may be used. The said driver is the same driver used in many products, such as many commercially available electronic organizers.

The micro controller unit's primary source of energy is the electrical energy produced by the thermoelectric unit.

Flexible Display Unit

Flexible display unit comprises commercially available flexible display, examples of which are electronically addressable display with encapsulated ink and organic liquid crystal display (OLED).

Electronically addressable display devices—such as commercial products of the firm Eink—www.eink.com—are typically flexible, are thin and have low power requirement. Due to the specific technology used, the displayed object—e.g. picture, text, graphics, or other combinations thereof—will remain displayed until the panel is activated again. In other words, each pixel of the display unit will retain its state even if the power is not supplied to the display unit any longer. The displayed object would change only when it is once again activated by the electrical current sent from the controller unit. The electronically addressable display can be implemented, as an example, using a system and method shown in U.S. Pat. No. 6,120,588 incorporated herein by reference to its entirety. The Eink display requires active matrix thin film transistor (TFT) as driver, and the said driver is commercially available.

Examples of commercially available OLED are the displays developed by Universal Display Corporation (www.universaldisplay.com). In this embodiment, the flexible liquid crystal display (LCD) by Viztec Inc. (www.viztec-.com) may be used. Since this display requires low voltage for the driver operation, the above mentioned thermoelectric unit would be sufficient as means of supplying the electrical energy.

Assembly of Units

Figure 2:
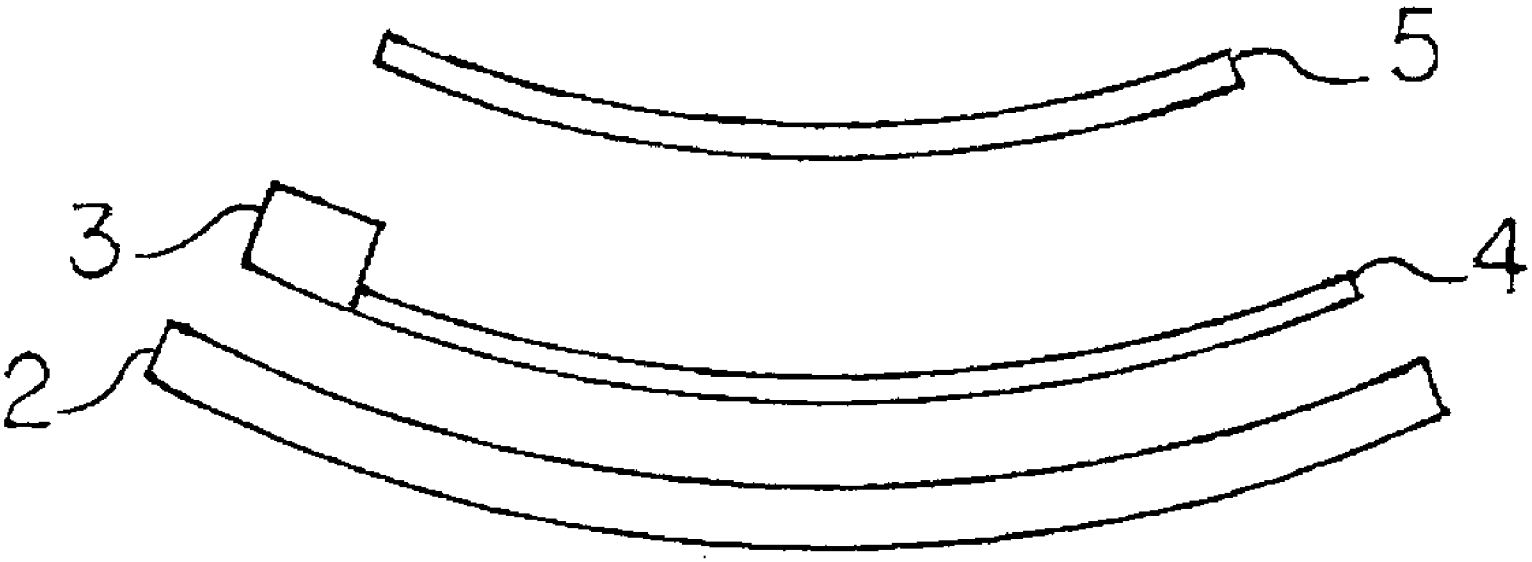
FIG. 2 is a schematic drawing of the exploded view of the invented device.

In FIG. 2, various units of the device are illustrated as follows:

Item 2 is a schematic drawing of the display unit, item 3 is a schematic drawing of micro controller unit, item 4 is a schematic drawing of the means of electrical connection between the units, and item 5 is a schematic drawing of the thermoelectric unit.

The packaging of the invention provides the means of holding the units permanently in their place. The units may be electrically connected by means of commercially available products, which in case of this embodiment, is a flexible circuit board. The said flexible printed circuit is commercially manufactured by various companies, and is used in products such as thin flexible calculators.

One method of assembly of the embodiment is described below:

- The display unit is bent to the same radius as the radius of the outside of a beverage holder
- The micro controller unit is put in place at the back of the unit
- The flexible printed circuit is placed on back of the display unit, such that it connects the micro controller unit to the display unit
- The thermoelectric unit is located on the inside of the above assembly, connected to the printed circuit A commercially available epoxy resin may be then injected in between the thermoelectric unit and the display unit—on both sides of the flexible printed circuit—whereby permanently holding the above units in place. In FIG. 2, the said epoxy resin would be injected between the thermoelectric unit 5 and the display unit 2.

The assembly described above may be then positions on the outside surface of a beverage holder. In this embodiment, an ordinary ceramic coffee mug is used. Industrial glues may be used as means of attaching the invented device to the coffee mug. FIG. 1 is the schematic drawing of the invented device 1 attached to the outside surface of a coffee mug.

Variations of the Embodiment

The invented device may comprise of one thermocouple element, or a number of separate thermocouple element. The electricity generated in each thermocouple is transferred to the micro-controller using conductive printed circuitry, conductive polymers, or other means of conducting electricity. The conducting elements may be made in separate pieces to conform to the geometry of the coffee mug (i.e. outside curvature) or may be one piece.

A thermoset plastic used instead of the epoxy resin would provide permanent structure which is rigid. Other means of attaching the units together may also be used instead of the epoxy resin, such as glue, soldering or similar means, whereby providing a flexible structure.

The invented device may be attached to the mug temporarily by means of special glues or similar means, whereby the device may be then peeled off the heat source or be reattached.

The beverage holder may also be designed with a frame attached to the outside surface of the beverage holder, whereby the invented device may slide into the frame, while the said frame keeps the device in place and holds it attached to the heat source.

The invented device may be attached to means of storing liquid. This may include various vessels, kitchen kettle, or similar means. In these applications, the invented device in FIG. 2 would be attached to the said means of storing liquid, such that the thermo electric unit 5 would be directly connected or in close vicinity to the said means, and the device conforming to the outside contour of the said means.

A means of storing the electrical energy (such as a commercially available capacitive element) may be added to the device, whereby electrical energy produced by the thermoelectric unit may be stored. This electrical energy may then be released over time such that the displayed visual effect may change over time. For instance, instead of showing a picture once the coffee is poured in the beverage holder, we may have the picture changing over the time until there is no more electrical energy is left in the electrical storage means. As a more particular example, we may have a coffee mug which displays a new picture once the coffee is poured into it, and a number of other pictures are displayed sequentially as the coffee is being consumed, without adding additional hot beverage. In such cases, the micro controller may comprise of a standard clock circuitry (not a commercial clock, but clock as defined in standard electronic engineering text). The Means of permanently storing the electrical energy may be used, whereby allowing the electrical energy generated by the thermoelectric unit to be stored. Thin film rechargeable batteries may be utilized as the said means. An example of implementation of such battery is the rechargeable battery developed by Front Edge Technology Inc. (www.front-edgetechnology.com). Such flexible thin battery may be placed between the thermoelectric unit and the display unit, and connected to the thermoelectric unit by means of standard electrical connections, whereby storing the electrical energy and releasing the energy as required by the micro controller unit. In this case, the micro controller unit may comprise of the required electronic circuit to monitor the storing and release of energy. Such electronic circuitry is available commercially and examples may be obtained off the shelf.

The invented device may comprise of non rechargeable means of storing electrical energy. Commercial batteries may be used in addition to the thermo electric unit, whereby increasing the available electrical energy.

Means of storing electrical energy may be positions between thermoelectric unit 5 and the display unit 2 in FIG. 2.

The invented device may comprise of heat sensing elements, and the signal from heat sensors may be transmitted to the micro controller unit, whereby causing a particular visual effect to be displayed. An application of the said case may be the invented device being used as thermometer, such that the means of sensing heat senses the temperature and sends the signal to the micro controller and the said micro controller sends the relevant signal to the display unit, whereby displaying the temperature of the heat source. An example of the heat sensing element that may be used in conjunction with the invented device as described above is Thin-Film Heat Flux Sensor produced by the firm Newport (www.newportus.com). The heat sensing elements may be positioned attached to the heat source next to or separate from the invented device, and connected to the micro controller by means of electrical connections explained elsewhere in this application.

Bluetooth wireless technology allows various products to communicate with each other, and transfer data from one to the other. The invented device may comprise of a Bluetooth element, whereby the device would receive data from another Bluetooth product. The received data may be used to over write the programmed data stored in the micro controller unit, or modify it. One may refer to commercial examples of Bluetooth by visiting www.bluetooth.com. The invented device may comprise of the appropriate Bluetooth component, chosen based on the power requirement of the said component and technical specifications of the display unit, and available electrical power. The Bluetooth component may be positioned between the display unit 2 and the thermoelectric unit 5 in FIG. 2, or placed outside this space and connected to the micro controller using commercial electrical connections.

I claim:

1. A device comprising of:

a thermoelectric unit;

a micro controller unit;

a flexible display unit;

a container that contains a liquid, the container having an outside surface, and the thermoelectric unit, micro controller unit and the flexible display unit are mounted on the outside surface; and electrical connections between the aforementioned units, wherein the flexible display unit displays visual effects determined by the micro controller unit, the device is powered primarily by heat from the liquid in the container, and the heat is transformed into electrical energy by the thermoelectric unit.

2. A device comprising; the device in claim 1, and one or more electronic capacitors.

3. A device comprising the device in claim 1, and one or more rechargeable or non rechargeable electrical batteries.

4. A device comprising the device in claim 1, and one or more heat sensing components.

5. A device comprising the device in claim 1, and a bluetooth device or component wherein said blue tooth or component receives the wireless signal and communicates with the micro controller unit, and the micro controller unit displays visual effects not previously programmed in the micro controller.

6. A device comprising the device in claim 1, and a bluetooth device or component, and the microcontroller unit being associated with a program, wherein said blue tooth or component receives the wireless signal and communicates with the micro controller unit causing the program that to be altered.

* * * * *